US005767782A

United States Patent [19]

Mongeau

[11] Patent Number: 5,767,782

[45] Date of Patent: Jun. 16, 1998

[54] GUARD FOR VISUAL SIGNAL DEVICE

[75] Inventor: James A. Mongeau, Marlboro, Mass.

[73] Assignee: Space Age Electronics, Inc., Marlboro, Mass.

[21] Appl. No.: 683,038

[22] Filed: Jul. 16, 1996

[51] Int. Cl.[6] ..... G08B 23/00

[52] U.S. Cl. ..... 340/693; 340/815.49; 248/551; 362/185; 49/50

[58] Field of Search ..... 340/815.49, 815.73, 340/297, 300, 302, 321, 908.1, 944, 693; 248/302, 551, 553; 362/185, 186

[56] References Cited

U.S. PATENT DOCUMENTS

| | | | |
|---|---|---|---|
| 4,344,114 | 8/1982 | Denhart | 362/147 |
| 5,149,039 | 9/1992 | Peterson et al. | 248/300 |
| 5,297,011 | 3/1994 | Triunfol | 362/147 |
| 5,388,800 | 2/1995 | Fry | 248/551 |

OTHER PUBLICATIONS

"Underwriter Laboratories (UL) 1971", 'Signaling Device for the Hearing Impaired', published Aug. 24, 1993, pp. 31–34.

*Primary Examiner*—Jeffery Hofsass
*Assistant Examiner*—Timothy Edwards, Jr.
*Attorney, Agent, or Firm*—Gary D. Clapp, Esq.

[57] ABSTRACT

An alarm guard for use with an alarm signaling device that is installed to meet Underwriter laboratories (UL) 1971 requirements and that includes a chassis mountable to a surface and a visual signaling element mounted on an outer face of the chassis and extending therefrom to be activated to indicate a hazardous condition. The alarm guard includes a mesh chassis guard enclosing at least four sides of the chassis and a visual indicator guard including a plurality of guard elements mounted to the chassis guard adjacent the visual signaling element. The guard elements may be comprised of straight and curved segments and extend from the outer face of the chassis and are spaced apart along the vertical and horizontal faces of the visual signaling element to provide vertical and horizontal openings sufficient to provide a required emitted light pattern in each plane of light emission. The extension of each guard and the separation between adjacent guard elements are selected to protect the visual signaling element from a predetermined generally spherical object. The chassis guard may extend over at least a portion of the outer face of the chassis outside of the visual signaling element and a segments of the guard element may extends across the outer face of the chassis be attached to the chassis guard.

5 Claims, 6 Drawing Sheets

SIGNAL LIGHT INTENSITIES

| AREA TO BE SIGNALED | INSTALLATION | MOUNTING HEIGHT | REQUIRED INTENSITY |
|---|---|---|---|
| SLEEPING | DETECTOR AND SIGNALING DEVICE IN SAME ROOM | 24 INCHES (0.61 m) OR LESS TO CEILING | 177 |
| SLEEPING | DETECTOR AND SIGNALING DEVICE IN SAME ROOM | MORE THAN 24 INCHES TO CEILING | 110 |
| SLEEPING | DETECTOR AND SIGNALING DEVICE NOT IN SAME ROOM | – | 110 |
| NON-SLEEPING | ANY ROOM | – | 15 |

NOTES

1 DISTANCE TO CEILING IS MEASURED FROM THE TOP OF THE SIGNAL LIGHT LENS TO THE CEILING.

2 INSTALLATION SHALL BE ILLUSTRATED AS REQUIRED IN PARAGRAPH 46.2.

3 THE VALUES NOTED FOR REQUIRED INTENSITY ARE EXPRESSED IN MINIMUM CANDELA-EFFECTIVE INTENSITY.

4 (–) = NO REQUIREMENT.

FIG. 1A

| DEGREES | PERCENT OF RATING |
|---|---|
| 0 | 100 |
| 5–25 | 90 |
| 30–45 | 75 |
| 50 | 55 |
| 55 | 45 |
| 60 | 40 |
| 65 | 35 |
| 70 | 35 |
| 75 | 30 |
| 80 | 30 |
| 85 | 25 |
| 90 | 25 |

| DEGREES θ | PERCENT OF RATING |
|---|---|
| 0 | 100 |
| 5 – 30 | 90 |
| 35 | 65 |
| 40 | 46 |
| 45 | 34 |
| 50 | 27 |
| 55 | 22 |
| 60 | 18 |
| 65 | 16 |
| 70 | 15 |
| 75 | 13 |
| 80 | 12 |
| 85 | 12 |
| 90 | 12 |

GUARD FOR VISUAL SIGNAL DEVICE

FIELD OF THE INVENTION

The present invention relates to a visual signaling device such as used for signaling fires and other hazardous conditions and, more particularly, to a guard for protecting the visual signaling element of an Underwriters Laboratory 1971 compliant Fire Alarm device.

BACKGROUND OF THE INVENTION

Alarm systems for indicating hazardous conditions, such as fires, are in common use, particularly in public or corporate buildings or other facilities where large numbers of people may be present, and provide visual or audible signals or both when a hazardous condition is detected. Such systems usually include a number of alarm signaling devices mounted on the walls or ceilings of a facility or in other visually prominent positions wherein each alarm signaling device includes a visual or audible signaling element, or more usually both, and electronics and circuitry to drive the signaling elements. The alarm signaling devices are usually connected through power/control cabling into a central control unit which may be manually or automatically activated when a hazardous conditions exits and which, in turn, activates the signaling devices to emit visual or audible signals.

A recurring problem with such alarm signaling devices, however, and in particular the visual signaling elements, is that the visual and audible signaling elements must be constructed and mounted in such a way that the emission patterns and power levels of the visual and audible signals emitted by the elements meet stringent Federal standards, examples of which are illustrated in FIGS. 1A, 1B, 1C, ID and 1E herein, which are drawn from the newly imposed requirements of Underwriters Laboratory 1971 pages 31 through 34 published Aug. 24, 1993.

While guards have been designed for alarm signaling devices of the prior art, the guards of the prior art have, while protecting the signaling devices, necessarily obscured at least significant portions of the light signals radiated from the devices and have to some extent interfered with the audible emissions from the devices. It is apparent will be apparent from the illustrated emission patterns of the evolving government standards applying to such devices, however, such as the new Underwriters Laboratory 1971 standad, that in order to meet the requirements of the standards, the audible and visual signaling elements must be in an exposed position and, as a consequence, the visual signaling elements, in particular, are at risk of accidental or deliberate, malicious breakage.

While it is relative easy to provide protective guards or enclosures for the audible signaling elements, the prior art has not regarded protective guards or enclosures that allow full view of the visual signaling elements as possible because any contemplated guard or enclosure for the visual signaling element would, of necessity, interfere with the visual signal emission pattern. As such, the alarm signaling devices of the prior art either attempted to construct the visual signaling elements from transparent materials, such as plastic or glass, that could withstand accidental or deliberate impacts by itself, thereby greatly increasing the costs of the units, or ignored the problem and accepted the risk of damage to the visual signaling elements, or provided guards at the cost of obscuring at least significant portions of the emitted light pattern.

The present invention provides a solution to these and other problems of the prior art.

SUMMARY OF THE INVENTION

The present invention is directed to an alarm guard for use with an alarm signaling device that is installed to meet the requirement of Underwriter Laboratories (UL) 1971, pages 31 through 34, published Aug. 24, 1993 and that includes a chassis mountable to a surface and a visual signaling element mounted on an outer face of the chassis and extending therefrom to be activated to indicate a hazardous condition. According to the present invention, the alarm guard includes a mesh chassis guard enclosing at least four sides of the chassis and a visual indicator guard including a plurality of guard elements mounted to the chassis guard adjacent the visual signaling element wherein the guard elements extend from the outer face of the chassis by a distance at least equal to a distance between the outer face of the chassis and an outer face of the visual signaling element and are spaced apart along the vertical and horizontal faces of the visual signaling element to provide vertical and horizontal openings sufficient to provide a required emitted light pattern in each plane of light emission.

In a present embodiment of the invention, each guard element is comprised of a straight segment and a curved segment wherein the curved segments are located adjacent comers of the visual signaling element and the curved segments extend past upper and lower outer edges of the vertical faces of the visual signaling element and outwards at least to the outer face of the visual signaling element.

In addition, the distance that each guard element extends outwards from the face of the chassis and the separation between adjacent guard elements along the faces of the visual signaling element are selected to protect the visual signaling element from a predetermined generally spherical object, wherein the distance that each guard element extends outwards and the separation between adjacent guard elements is selected so that a circumference of the generally spherical object is separated from the outer face of the visual signaling element when the generally spherical object is in contact with outer portions of two adjacent guard elements such that a line connecting the outer portions of the two adjacent guard elements is a chord of the generally spherical object.

In further embodiment of the alarm guard, the chassis guard extends over at least a portion of the outer face of the chassis outside of the visual signaling element and, in certain embodiment, the chassis guard extends over at least a portion of the outer face of the chassis outside of an area extending horizontally from a least one vertical face of the visual signaling element. In still further aspects of this latter embodiment, a segment of at least one guard element extends across the outer face of the chassis along the edge of the area extending horizontally from a least one vertical face of the visual signaling element and is attached to the chassis guard.

DESCRIPTION OF THE DRAWINGS

The foregoing and other objects, features and advantages of the present invention will be apparent from the following description of the invention and embodiments thereof, as illustrated in the accompanying figures, wherein.

DESCRIPTION OF THE INVENTION

Figures 1B, 1C:
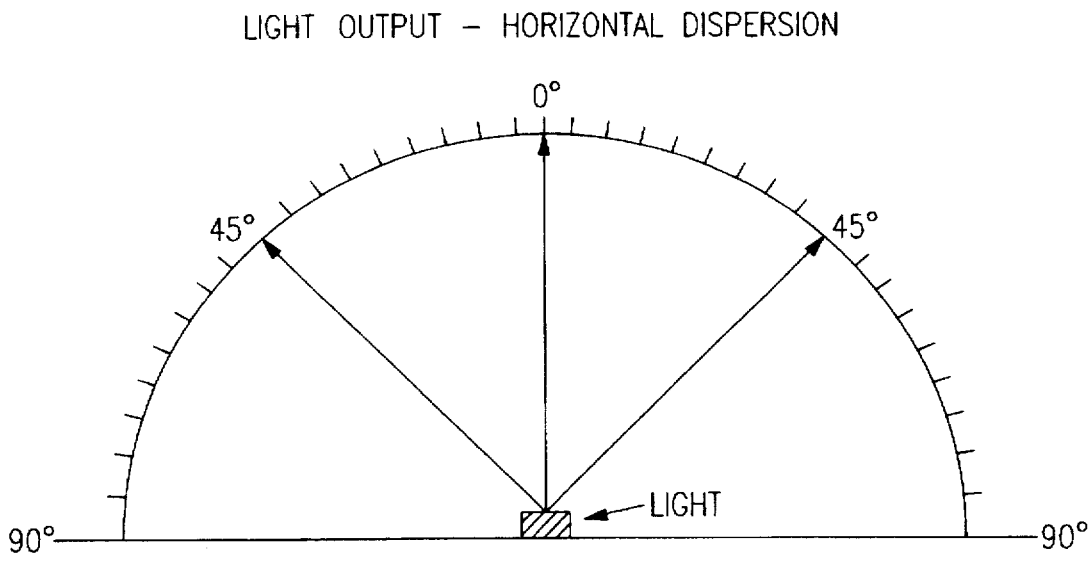
FIGS. 1A, 1B, 1C, ID and 1E are illustrations of the vertical and horizontal light emission patterns required of visual signaling elements of alarm signaling devices.
Figures 1D, 1E:
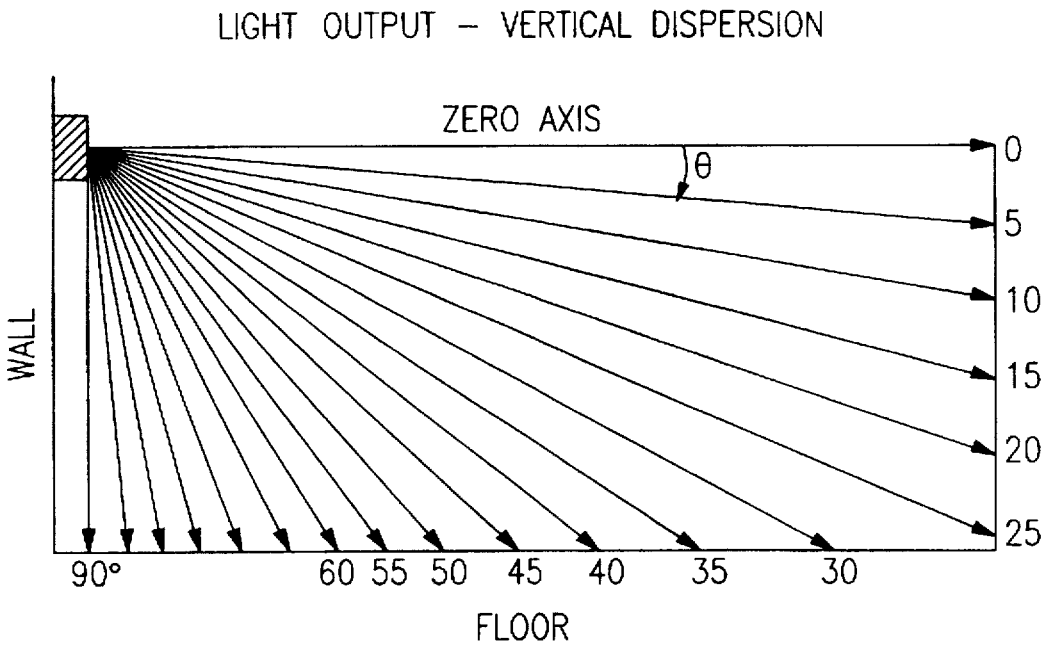
Figure 2:
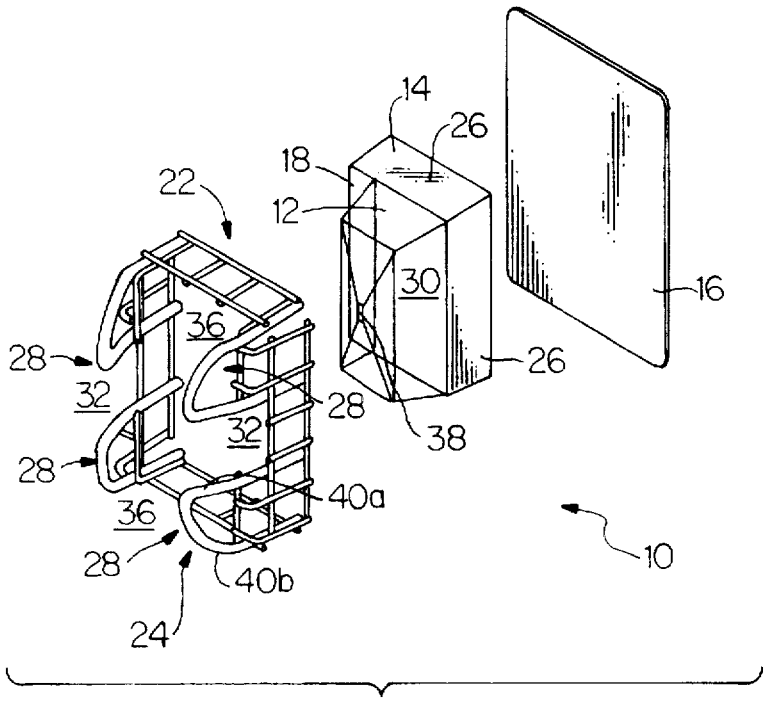
FIG. 2 is a perspective view of an alarm signaling device with an alarm guard of the present invention.
Figure 3:
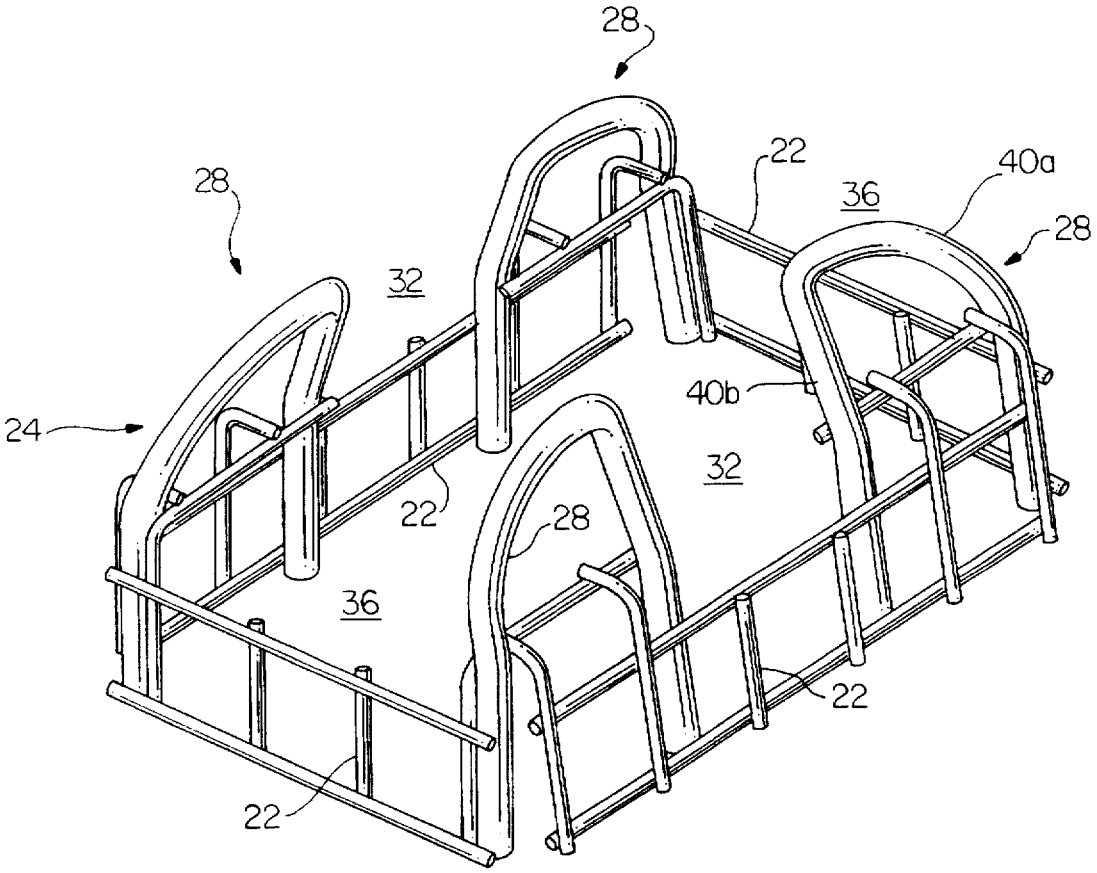
FIG. 3 is an enlarged perspective view of the alarm guard of FIG. 2.

Referring to FIGS. 2 and 3, therein is illustrated a first embodiment of the present invention wherein an Alarm Signaling Device 10 is shown as comprised of Visual Signaling Element 12 that is mounted on a Chassis 14 that, in turn, may be mounted to a Wall 16. In addition to providing a means for mounting Visual Signaling Element 12, Chassis 14 generally also houses an audible signaling element (not shown) and the circuitry to drive Visual Signaling Element 16 and the audible signaling element.

As shown, Visual Signaling Element 12 is mounted on Outward Face 18 of Chassis 14 to achieve the necessary visibility and is constructed in the manner well known to those of ordinary skill in the relevant arts to provide the required visual light emission pattern. In the present embodiment, for example, Visual Signaling Element 12 may be comprised of a strobe type light emitting element (not visible), while the externally visible part of Visual Signaling Element 12 is a transparent or translucent housing made, for example, of red glass or plastic.

As illustrated and as well understood in the relevant arts, the housing for Visual Signaling Element 12 provides both a housing for the light emitting element and as lens to provide the necessary light emission pattern. In the present embodiment, for example, the housing forming the external and visible portion of Visual Signaling Element 12 has a generally rectangular cross section and extends outwards from Outer Face. The housing portion of Visual Signaling Element 12 thereby has the general form of a truncated, rectangular pyramid and, as well understood by those of ordinary skill in the relevant arts, is thereby shaped to achieve the necessary emission pattern.

It will be appreciated by those of ordinary skill in the relevant arts, however, that the housing of Visual Signaling Element 12 may take still other forms, such as half cylinders and globes, that will provide the necessary light emission pattern.

As illustrated in FIGS. 2 and 3, Alarm Guard 20 of the present invention is comprised of a Chassis Guard 22 and a Visual Element Guard 24 wherein Chassis Guard 22 provides a mounting for Visual Element Guard 24 and protects Chassis 12 while Visual Element Guard 24 protects Visual Signaling Element 12.

Chassis Guard 22 in the present embodiment is essentially comprised of a mesh, for example, of welded or brazed 0.109 inch diameter mild steel wire, enclosing the four Sides 26 of Chassis 14 and extending at least along Sides 26 from the base of Chassis 14 to at least Outer Face 18 of Chassis 14 and attached to Chassis 12 by screws or clips or other fasteners or combinations thereof in a manner well understood by those of ordinary skill in the relevant arts. Chassis Guard 22 may also extend across the portion of Outer Face 18 of Chassis 14 not occupied by Visual Signaling Element 12. Chassis Guard 22 would, in a typical example, have a horizontal width of about 5 to 6 inches, a vertical height of about 3.5 to 4.0 inches and a depth (from the wall to the front face of Chassis 12, of 1.5 to 2.0 inches.

Visual Element Guard 24, in turn, is comprised of a plurality of Guard Elements 28 wherein each Guard Element 28 is attached to Chassis Guard 22 in a location adjacent to Visual Signaling Element 12 and extends outwards from Outer Face 18 by a distance at least equal to the extension of Visual Signaling Element 12 from Outer Face 18.

Guard Elements 28 are made, for example, of 0.25 inch diameter mild steel wire welded or brazed to Chassis Guard 22 and spaced apart along each of Vertical Faces 30 of Visual Signaling Element 12 by a distance, for example, approximately 2.0 inches, to provide Vertical Openings 32 sufficient to achieve the required emission pattern in the horizontal plane of emission and are spaced apart along each of Horizontal Faces 34 of Visual Signaling Element 12 by a distance, for example, approximately 2.50 inches, to provide Horizontal Openings 36 sufficient to achieve the required emission pattern in the vertical plane of emission, and would typically extend outwars by approximately 3.0 inches from the wall. It will be noted that Guard Elements 28 do not cover Outer Face 38 of Visual Signaling Element 12, thereby allowing unrestricted emission in that direction, and that Guard Elements 28, being comprised of wire or thin rod, occupy little of the area of the emitted light pattern and therefore have relatively little effect on the pattern of emitted light.

In the embodiment illustrated in FIGS. 2 and 3, it will be seen that there are four Guard Elements 28, generally located at each corner of Visual Signaling Element 12, and that each Guard Element 28 is comprised of a Straight Segment **40*a* and a Curved Segment 40b wherein Curved Segments 40*b* are located adjacent the outer corners if Visual Signaling Element 28, to thereby protect people and objects by avoiding an exposed sharp edge or corner. It will also be noted that Curved Segments 40*b* extend past the upper and lower outer edges Vertical Faces 30 and may be bent inwards, for example, by 20 to 30 degrees, to follow the shape of Vertical Faces 30**.

Finally, it will be noted that Guard Elements 28 may extend past Outer Face 38 by a distance chosen to protect Outer Face 38 from objects or projectiles having a diameter greater than a predetermined size and that the distance that Guard Elements 28 extend past Outer Face 38 is a function of the separation between Guard Elements 28, that is, the widths of Vertical Openings 32 and Horizontal Openings 36, and the minimum size of potential objects or projectiles to be protected against. It will be appreciated by those of ordinary skill in the relevant arts that these dimensions are readily calculated and are dependent upon specific circumstances. In a basketball court, for example, the minimum common projectile would be a basketball and the extension of Guard Elements 28 past Outer Face 38 could be less while in a handball court or at a baseball field the necessary extension would be greater and the widths of Vertical Openings 32 and Horizontal Openings 36 may have to be reduced.

In general, however, the distance that each guard element extends outwards from the face of the chassis and the separation between adjacent guard elements along the faces of the visual signaling element are selected to protect the visual signaling element from a generally spherical object of predetermined size by selecting the distance that each guard element extends outwards beyond the outer face of the visual signaling element and the separation between adjacent guard elements so that the circumference of the object does not contact the outer face of the visual signaling element when the object is in contact with outer portions of two adjacent guard elements such that a line connecting the outer portions of the two adjacent guard elements is a chord of the object.

Figure 4:
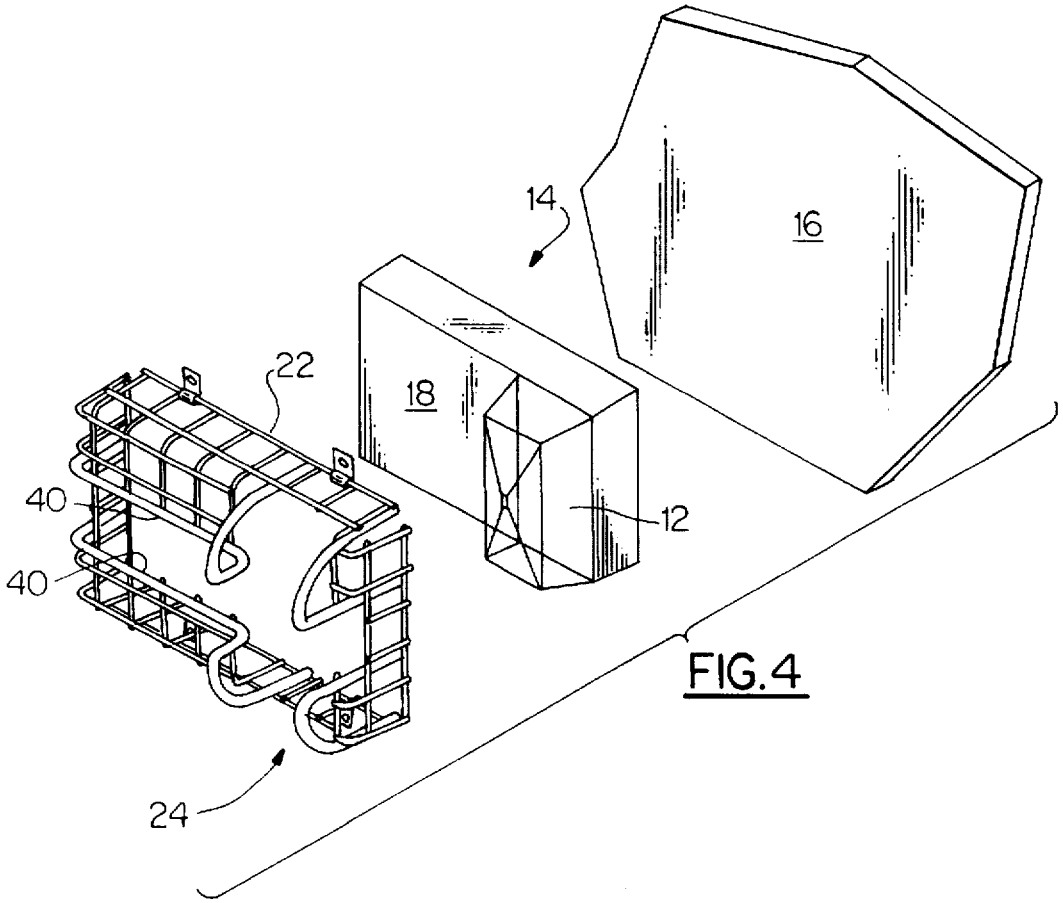
FIG. 4 is a perspective view of a second alarm signaling device with an alarm guard of the present invention; and, FIG. 5 is an enlarged perspective view of the alarm guard of FIG. 4.
Figure 5:
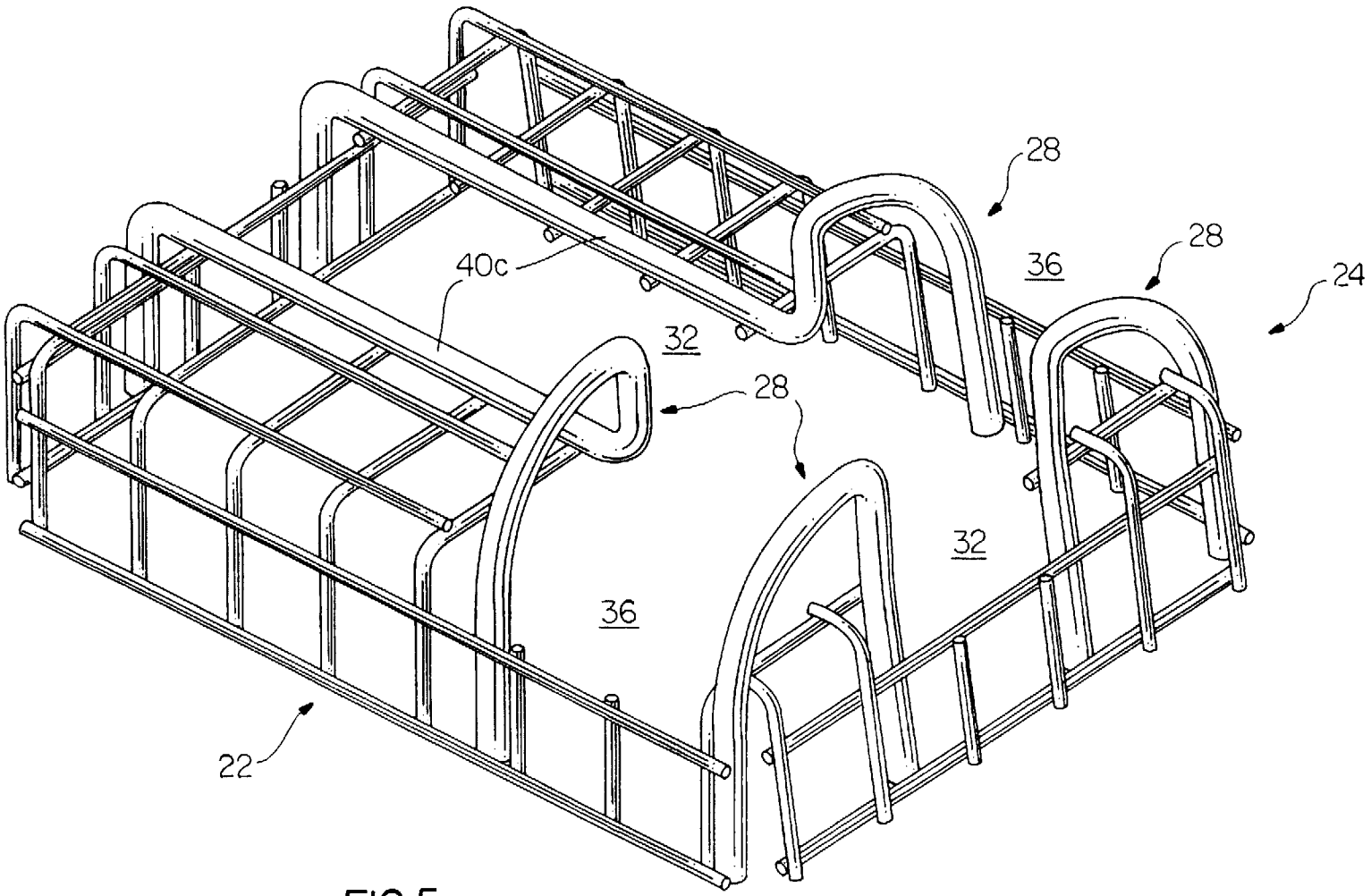

Referring now to FIGS. 4 and 5, therein is illustrated another embodiment of the Alarm Guard 20 of the present invention for an Alarm Signaling Device 10 having a different Chassis 14 configuration from that illustrated in FIG. 2, wherein the Chassis 14 shown in FIG. 4 has a greater extension or dimension along one axis, the example shown therein having a greater dimension along the horizontal axis and, in a typical device, the horizontal width of Chassis Guard would be approximately 7.5 inches with most of the increased width appearing to one side of Viaual Element Guard 24. It will be seen therein, however, that Chassis Guard 22 and Guard Elements 28 of Visual Element Guard 24 are generally similar to those illustrated in FIGS. 2 and 3.

In FIGS. 4 and 5, however, the extension of Chassis Guard 22 over at least a portion of Outer Face 18 is illustrated, particularly in the extended area of Chassis 14, wherein it is shown that Chassis Guard 22 covers a strip approximately 1.0 to 1.5 inch wide at the top and bottom of Outer Face 18 in the horizontally extended portion of Outer Face 18. It is also shown that while Chassis Guard 22 extends over a portion of Outer Face 18, Chassis Guard 22 does not extend to cover the area of Outer Face 18 extending from the adjacent Vertical Face 30 of Visual Signaling Element 12 to the nearly the opposite Side 26 of Chassis 14, this area, approximately 2 inches wide, being left uncovered to prevent possible interference with the pattern of emitted light. It will also be noted that Extended Segments 40*c* of the Segments 40*a,b* of Visual Element Guard 24 intersecting Chassis Guard 22 at Outer Face 18 adjacent this opening in Chassis Guard 22 are extended across Outer Face 18 from that Vertical Face 30 to the opposite Side 26 of Chassis 14 and along the edges of the opening and attached to Chassis Guard 22 along the edges of the opening to strengthen Alarm Guard 20 in this area. In alternate embodiments of Alarm Guard 20, however, Chassis Guard 22 may extend entirely across this portion of Outer Face 18 so long as the light emitting element and housing of Visual Signaling Element 12 are constructed to extend sufficiently in front of Outer Face 18 so that Chassis Guard 22 does not interfere with the necessary light emission pattern.

Finally, it will be noted that the present invention is not limited to the embodiments illustrated in FIGS. 2 through 5 and that Alarm Guard 20 may take different forms while adhering to the principles of the invention described herein above. For example, Chassis Guard 22 and Visual Element Guard 24 may be constructed as a single element, such as a single piece of mesh of sufficient weight and strength, or may be constructed of a single cast or molded transparent plastic or glass material. Likewise, the specific shapes and forms of Chassis Guard 22 and Visual Element Guard 24 may differ from those illustrated herein to conform to different dimensions or shapes of Chassis 14 and Visual Signaling Element 14. For example, Visual Signaling Element 14 may assume a pyramidal or cylindrical shape, whereupon the numbers,locations or shapes of Guard Elements 28 would be modified to conform to the new shape.

Therefore, while the invention has been particularly shown and described with reference to preferred embodiments of the apparatus and methods thereof, it will be also understood by those of ordinary skill in the art that various changes, variations and modification in form, details and implementation may be made therein without departing from the spirit and scope of the invention as defined by the appended claims. Therefore, it is the object of the appended claims to cover all such variation and modifications of the invention as come within the true spirit and scope of the invention.

What is claimed is:

1. An alarm guard for use with an alarm signaling device compliant with the requirements of Underwriter Laboratories (UL) 1971 standards, pages 31 through 34, as published Aug. 24, 1993, and including a chassis mountable to a surface and a visual signaling element mounted on an outer face of the chassis and extending therefrom to be activated to indicate a hazardous condition, the alarm guard comprising:

a chassis guard enclosing at least four sides of the chassis, and a visual indicator guard including a plurality of guard elements mounted to the chassis guard adjacent the visual signaling element the guard elements extending from the outer face of the chassis by a distance at least equal to a distance between the outer face of the chassis and an outer face of the visual signaling element and enclosing the chassis and the visual signaling element, and being spaced apart along the vertical and horizontal faces of the visual signaling element to provide vertical and horizontal openings sufficient to provide an emitted light pattern in each plane of light emission conforming to the requirements of Underwriters Laboratory (1971), pages 31 through 34, and to prevent contact between the visual signaling element and an objects external to the alarm guard, and wherein each guard element is comprised of a straight segment and a curved segment wherein the curved segments are located adjacent corners of the visual signaling element and the curved segments extend past upper and lower outer edges of the vertical faces of the visual signaling element and outwards beyond the outer face of the visual signaling element.

2. The alarm guard of claim 1 wherein:

the distance that each guard element extends outwards from the face of the chassis and the separation between adjacent guard elements along the faces of the visual signaling element are selected to protect the visual signaling element from an external object, wherein the distance that each guard element extends outwards and the separation between adjacent guard elements is selected so that a circumference of the generally spherical object is separated from the outer face of the visual signaling element when a generally spherical object is in contact with outer portions of two adjacent guard elements such that a line connecting the outer portions of the two adjacent guard elements is a chord of the generally spherical object.

3. The alarm guard of claim 1, wherein:

the chassis guard extends over at least a portion of the outer face of the chassis outside of the visual signaling element.

4. The alarm guard of claim 3, wherein:

the chassis guard extends over at least a portion of the outer face of the chassis outside of an area extending horizontally from a least one vertical face of the visual signaling element.

5. The alarm guard of claim 4, wherein:

a segment of at least one guard element extends across the outer face of the chassis along the edge of the area extending horizontally from a least one vertical face of the visual signaling element and is attached to the chassis guard.

* * * * *